US006288495B1

(12) United States Patent
Yashiro

(10) Patent No.: US 6,288,495 B1
(45) Date of Patent: Sep. 11, 2001

(54) DRIVING APPARATUS FOR PLASMA DISPLAY PANEL

(75) Inventor: Junichi Yashiro, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/528,440

(22) Filed: Mar. 17, 2000

(30) Foreign Application Priority Data

Mar. 30, 1999 (JP) ..... 11-088964

(51) Int. Cl.[7] ..... G09G 3/10

(52) U.S. Cl. ..... 315/169.1; 345/60; 345/63; 345/55; 315/169.4

(58) Field of Search ..... 315/169.4, 169.1, 315/169.2, 169.3; 345/60, 55, 63

(56) References Cited

U.S. PATENT DOCUMENTS 4,017,762 4/1977 Criscimagna et al. ..... 315/169.4
4,079,290 3/1978 Trushell ..... 315/169.4
5,233,272 * 8/1993 Whang et al. ..... 315/168
5,583,527 * 12/1996 Fujisaki et al. ..... 345/55
5,909,201 * 6/1999 Hush et al. ..... 345/74
5,956,014 * 9/1999 Kuriyama et al. ..... 345/147
6,034,482 * 3/2000 Kanazawa et al. ..... 315/169.4
6,061,040 * 5/2000 Onodera et al. ..... 345/67
6,100,859 * 8/2000 Kuriyama et al. ..... 345/60
6,107,978 * 8/2000 Nagaoka ..... 345/60

* cited by examiner

*Primary Examiner*—Don Wong
*Assistant Examiner*—Tuyet T. Vo
(74) *Attorney, Agent, or Firm*—Young & Thompson

(57) ABSTRACT

The invention provides a driving apparatus for a plasma display panel which performs optimization of a discharge voltage automatically and achieves reduction of the number of steps for adjustment and reduction of a secular change of the display quality. The driving apparatus for a plasma display panel includes a discharging situation detection section for detecting a variation of a state of each of cells of the plasma display panel which has an influence on a display quality such as a temperature, an elapsed time or the like of the cell, and a control section for calculating an optimum driving voltage for a scanning electrode or a write electrode of the cell in response to the discharging situation of the cell detected by the discharging situation detection section and causing the optimum driving voltage to be applied to the scanning electrode or the write electrode of the cell to cause the cell to discharge.

1 Claim, 5 Drawing Sheets

Vs VOLTAGE CONTROL FLOW CHART

DRIVING APPARATUS FOR PLASMA DISPLAY PANEL

BACKGROUND OF THE INVENTION

1. Field of the Invention

The present invention relates to a driving voltage control system for a plasma display panel, and more particularly to a plasma display panel driving apparatus wherein selective discharging of cells is performed in an optimum state to display an image in an optimum voltage condition.

2. Description of the Related Art

Normally, a plasma display panel of the type mentioned performs selective discharge and light emission of pixels making use of a characteristic that there is a difference between a discharge starting voltage and a discharge maintaining voltage of gas filled between two glass plates.

For example, if a certain cell is selected so as to emit light, discharging for writing is performed for the cell in advance so that charge called wall charge is stored in a wall in the inside of the cell.

On the other hand, if a cell is selected so as not to emit light, discharging for writing is not performed, and consequently, wall charge is not accumulated.

After, from among cells of all of pixels of a plasma display panel, those cells which are to emit light depending upon presence of wall charge are selected in this manner, a discharge maintaining pulse is applied at a time to all cells.

Generally, since discharge gas used for a plasma display panel has a discharge starting voltage set higher than its discharge maintaining voltage as seen in FIG. 1, to those cells which have wall charge because a discharge maintaining pulse has been applied thereto, that is, to those cells with which writing discharging has been performed in advance, a voltage corresponding to the wall charge is applied in addition to the discharge maintaining voltage. Consequently, those cells begin to discharge and emit light.

However, those cells to which no wall charge has been given cannot enter a light emitting state only with the discharge maintaining voltage.

While light emission control of a plasma display panel conventionally makes use of presence or absence of wall charge and a difference between a discharge maintaining voltage and a discharge starting voltage in this manner, it is sometimes difficult to control all cells in an optimum state against a secular change or a temperature variation.

An exemplary one of conventional driving apparatus for a plasma display panel is shown in FIG. 5. Referring to FIG. 5, the driving apparatus for a plasma display panel shown includes a scanning electrode driver 16, a write electrode driver 11 and a common electrode driver 12 for a main scanning electrode set 50, a write electrode set 51 and a common electrode set 52 of a plasma display panel PDP, respectively. The scanning electrode set 16 includes a pulse generator 13 for generating various pulse signals, a maintaining pulse generator 14 for generating a maintaining pulse signal, and a switching circuit 15 for selectively outputting one of an output pulse signal of the pulse generator 13 and the maintaining pulse signal from the maintaining pulse generator 14. The scanning electrode set 50 is driven by a maintaining voltage (Vs) power supply 2 and drives the scanning electrode set 50 in accordance with the pulse signal selected by the switching circuit 15. Meanwhile, the write electrode driver 11 is driven by a discharging voltage (Vd) power supply 5 and drives the write electrode set 51 in accordance with a normal signal (normal image signal) originated from a normal signal inputting section 6 and processed by a signal processing circuit 10.

Consequently, depending upon a cell, if such a phenomenon occurs that, although wall charge is not formed therein, the cell discharges when only the discharge maintaining voltage is applied thereto, or although the cell has wall charge and must emit light, discharge and emission of light does not occur, this cannot be observed. In this instance, it is normally the actual state of things that it is confirmed through visual observation if those cells in the screen which should emit light do not emit light or if those cells which should not emit light emit light, and the setting of the discharge maintaining voltage or the writing voltage is adjusted manually.

Therefore, where it is necessary to adjust the discharge maintaining voltage or the writing voltage in accordance with the necessity upon manufacture of the product or when the situation of a discharging phenomenon varies because of a secular change or from some other reason, the adjustment operation is cumbersome and besides requires long time.

SUMMARY OF THE INVENTION

It is an object of the present invention to provide a plasma display panel driving apparatus which achieves equation of adjustment operation and reduction of the adjustment time to reduce the number of steps of adjustment upon manufacture of the product and is easy to maintain the display quality when a secular change occurs with the product.

In order to attain the object described above, according to the present invention, confirmation of those cells which should emit light and those cells which should not emit light is automatically performed making use of discharge current and adjustment of a discharge maintaining voltage or a writing voltage is performed automatically.

More particularly, according to the present invention, there is provided a driving apparatus for a plasma display panel wherein discharging gas is filled and enclosed between two glass plates and a plurality of scanning electrodes are provided in a horizontal direction while a plurality of write electrodes are provided in a vertical direction on inner faces of the glass plates and wherein a voltage is selectively applied between the electrodes to cause cells defined by the scanning electrodes and the write electrodes to discharge and emit light, comprising discharging situation detection means for detecting a variation of a state of each of the cells which has an influence on a display quality such as a temperature, an elapsed time or the like of the cell, and control means for calculating an optimum driving voltage for the scanning electrode or the write electrode of the cell in response to the discharging situation of the cell detected by the discharging situation detection means and causing the optimum driving voltage to be applied to the scanning electrode or the write electrode of the cell to cause the cell to discharge.

Where the discharging situation detection means varies a discharge voltage for light emission of the scanning electrode to detect the light emitting discharging situation, the control means may calculate an optimum voltage necessary to drive the scanning electrode and apply the optimum voltage to the scanning electrode. In this instance, the discharging situation detection means may include a current detection circuit for detecting current to flow to the scanning electrode and an integration circuit for integrating the detection current of the current detection circuit, and the control means may include a microcomputer which calculates the optimum voltage necessary to drive the scanning electrode from an output of the integration circuit and controls a voltage of a power supply for the scanning electrode.

Alternatively, where the discharging situation detection means varies a discharge voltage for the write electrode to detect the light emitting discharging situation, the control means may calculate an optimum voltage necessary to drive the write electrode and applies the optimum voltage to the write electrode. In this instance, the discharging situation detection means may include a current detection circuit for detecting current to flow to the scanning electrode and an integration circuit for integrating the detection current of the current detection circuit, and the control means may include a signal switching circuit for first inputting an all-black signal and then inputting an all-white signal as a testing signal for detection of the discharging situation to a driver for the write electrode, and a microcomputer for calculating an optimum voltage necessary to drive the write electrode from an output of the integration circuit when the all-black signal is inputted and an output of the integration circuit when the all-white signal is inputted and controlling a voltage of a power supply for the write electrode to the optimum voltage.

With the driving apparatus for a plasma display panel, setting of the voltage for maintaining discharge or control of the maintaining voltage, reading of the maintaining voltage and calculation of the optimum maintaining voltage are all performed automatically. Consequently, such a phenomenon that, although wall charge is not formed, discharge occurs when only the discharge maintaining voltage is applied, or although wall charge is present and light must be emitted, discharge and emission of light does not occur is eliminated, and equation of the adjustment operation and reduction of the adjustment time can be achieved. Besides, reduction of the number of steps of adjustment upon manufacture of a product and keeping of the display quality when a secular change occurs with the product can be performed efficiently.

Further, in connection with the advantages described above, also where the write discharge maintaining voltage for of vertical lines is varied and a light emitting discharging situation is detected and then the optimum discharge maintaining voltage necessary for driving is calculated and the write voltage is variably controlled in response to a result of the calculation, similar advantages can be obtained. Further, upon maintenance service, for example, a program therefor is installed in the product, and if a series of operations are performed at a certain time when the maintenance service does not have an influence on an actual operation of the plasma display panel, for example, when power supply is made available at intervals of a predetermined period, then the secular change of the display quality of the product can be minimized. In this manner, the plasma display panel driving apparatus exhibits various superior effects.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENT

Figure 2:
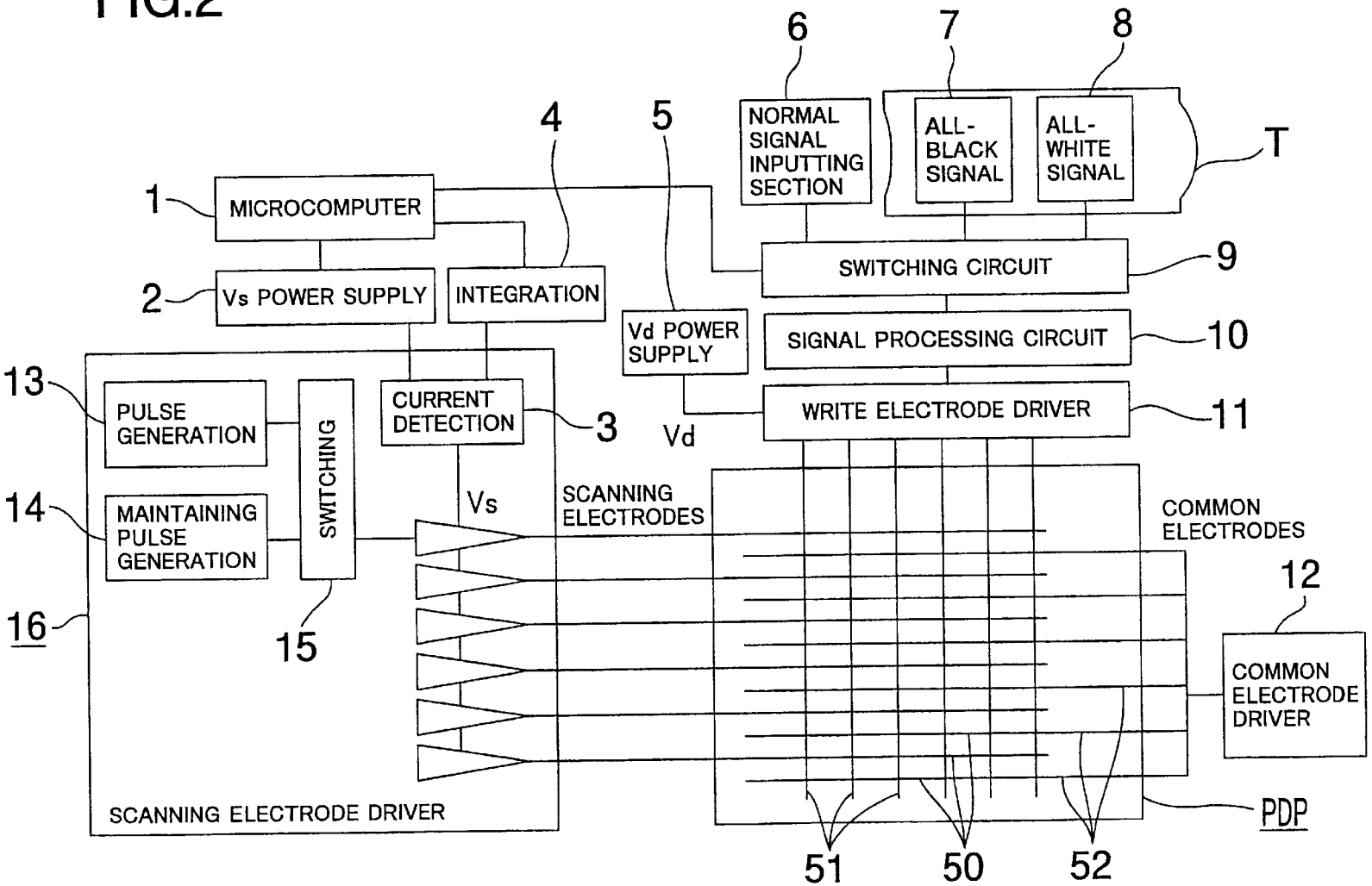
FIG. 2 is a block diagram of a driving apparatus for a plasma display panel to which the present invention is applied.
Figure 5:
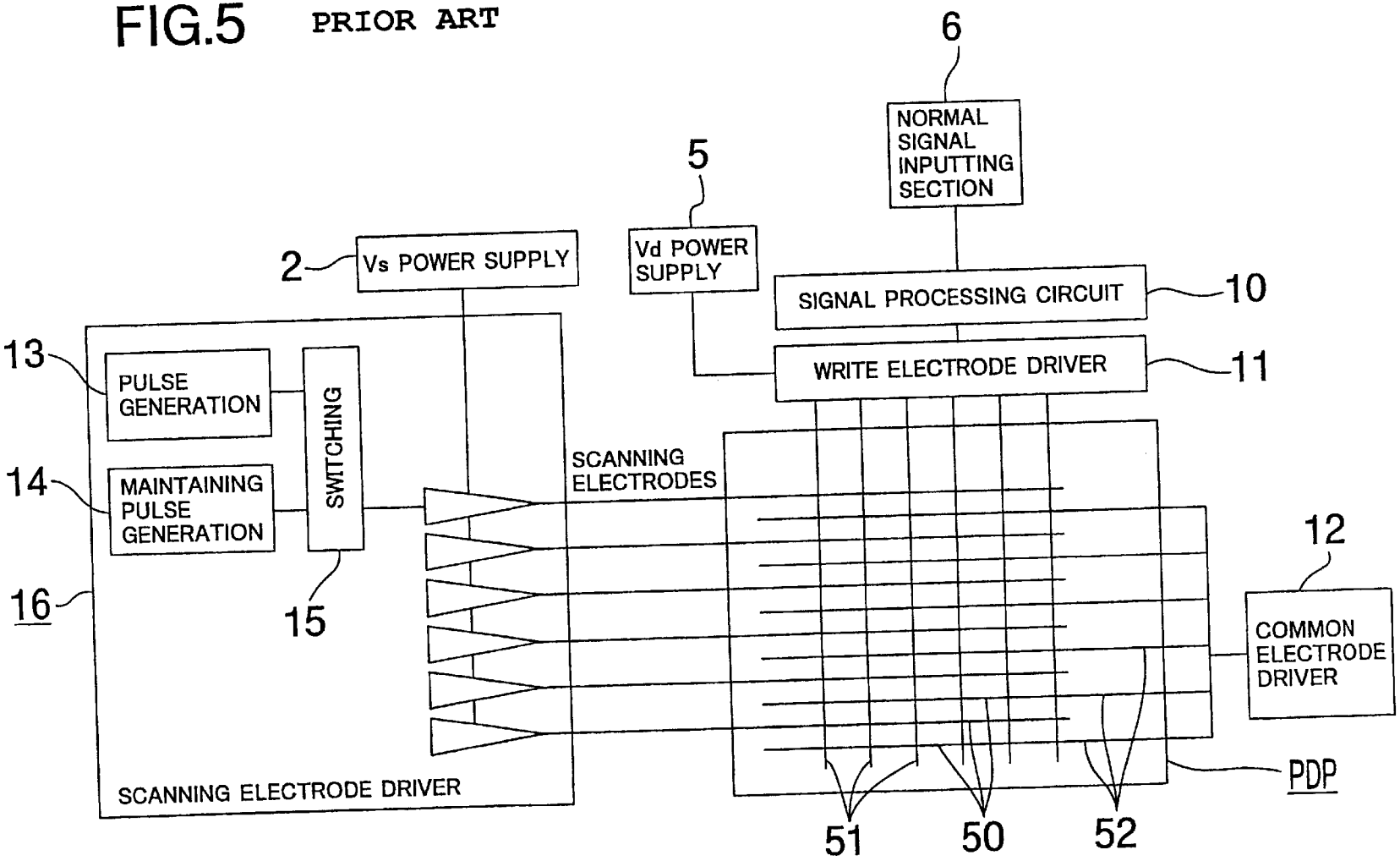
FIG.5 PRIOR ART
FIG. 5 is a block diagram showing a conventional driving apparatus for a plasma display panel.

Referring first to FIG. 2, there is shown a driving apparatus for a plasma display panel to which the present invention is applied. The plasma display panel PDP in which the driving apparatus is incorporated includes a main scanning electrode set 50, a write electrode set 51 and a common electrode set 52 similar to those described hereinabove with reference to FIG. 5. Meanwhile, the driving apparatus for the plasma display panel PDP includes a maintaining voltage (Vs) power supply 2, a scanning electrode driver 16 which in turn includes a pulse generator 13, a maintaining pulse generator 14 and a switching circuit 15, a write electrode driver 11, a common electrode driver 12, a discharging voltage (Vd) power supply 5, a normal signal inputting section 6, and a signal processing circuit 10, which are all similar to those of FIG. 5 described hereinabove. The plasma display panel further includes a microcomputer 1, a current detection circuit 3, an integration circuit 4, a testing circuit T, and a switching circuit 9. In the driving apparatus for a plasma display panel shown in FIG. 2, a discharge maintaining voltage Vs of the maintaining voltage (Vs) power supply 2 is controlled.

In particular, the current detection circuit 3 is additionally provided for a power supply to the scanning electrode driver 16 for the plasma display panel PDP. Further, since discharge current has a pulse waveform, the integration circuit 4 is additionally provided so that a discharging state can be detected. Furthermore, in order to provide a predetermined write signal to the write electrode driver 11, the switching circuit 9 for inputting an all-black signal 7 and an all-white signal 8 from the testing circuit T as a test signal for detection of a discharging situation to the signal processing circuit 10 is additionally provided in a stage preceding to the signal processing circuit 10.

The microcomputer 1 is additionally provided to control the current detection circuit 3, integration circuit 4 and switching circuit 9 so that detection of discharge current by the current detection circuit 3, switching of an input signal to the signal processing circuit 10 among the all-white signal 8, the all-black signal 7 and a normal signal from the normal signal inputting section 6 by the switching circuit 9, controlling of the maintaining voltage, reading of the maintaining voltage (Vs), calculation of an optimum maintaining voltage, and variation of the maintaining voltage (VS) of the maintaining voltage (Vs) power supply 2 can be performed using a program installed in the microcomputer 1.

Figure 3:
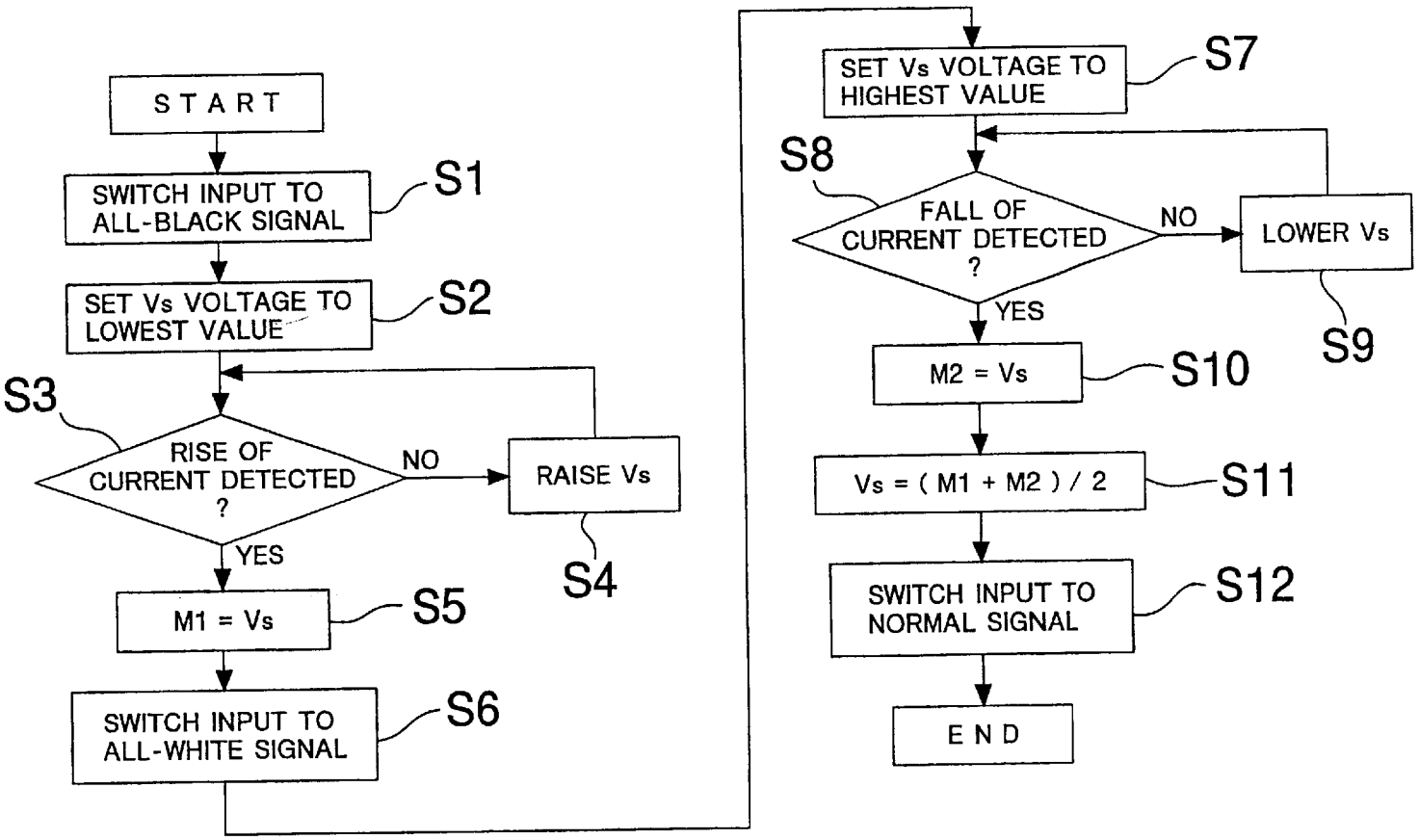
FIG. 3 is a flow chart illustrating operation of the driving apparatus for a plasma display panel of FIG. 2.

Subsequently, operation of the driving apparatus for a plasma display panel having the construction described above is described with reference to FIG. 3.

First, a signal to be inputted to the signal processing circuit 10 is switched from the normal signal from the normal signal inputting section 6 to the all-black signal 7 from the testing circuit T by the switching circuit 9 under the control of the control microcomputer 1 (step S1), and then the maintaining voltage Vs is set to the lowest voltage thereof by the maintaining voltage (Vs) power supply 2 under the control of the microcomputer 1 (step S2). In this state, the screen of the plasma display panel PDP exhibits an all-black state wherein all of the cells do not emit light.

Figure 1:
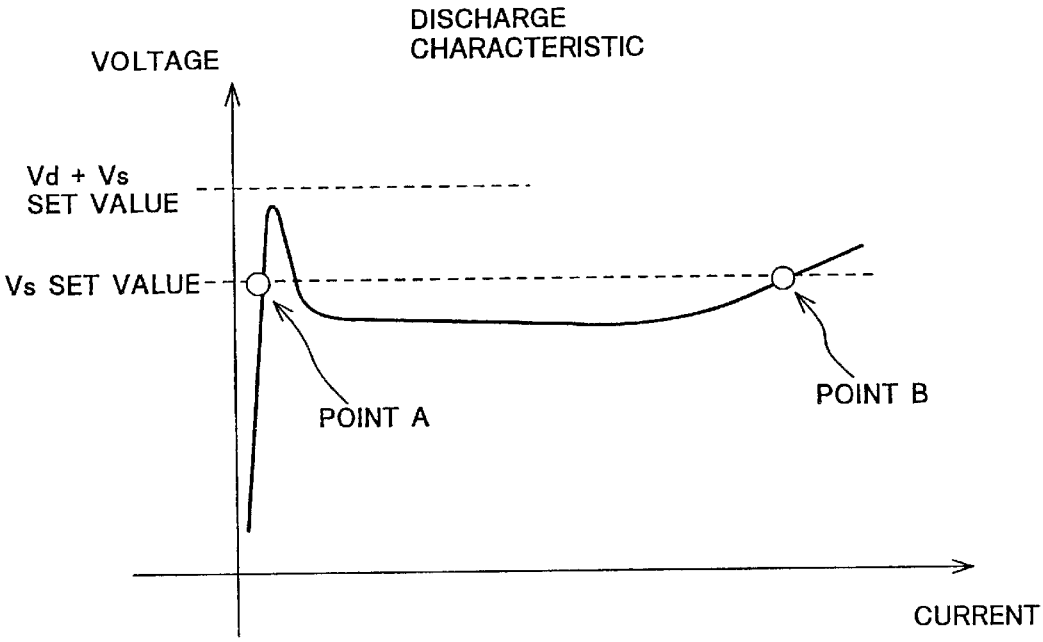
FIG. 1 is a graph illustrating a voltage-current characteristic as a general discharging characteristic.

If, in the state described above, wall charge originating from a write discharge voltage Vd is not present in a cell, then since the voltage applied to the cell is only the maintaining voltage Vs, the discharge current becomes dark current and remains at a point A illustrated in FIG. 1. Consequently, the cell does not emit light.

However, where wall charge is present in a cell, the voltage applied to the cell is equal to a Vs+Vd set value, and current in the glow discharge region flows and the voltage can move to another point B illustrated in FIG. 1.

Then, while current detection is successively performed by the current detection circuit 3 (step S3), the maintaining voltage Vs is raised gradually (step S4) to detect the maintaining voltage Vs immediately before the cell begins to emit light (the voltage immediately before current detection is performed). Then, the detected voltage value Ml is stored into a memory in the microcomputer 1.

Then, the input signal to the signal processing circuit 10 is switched to the all-white signal 8 (step S6), and now, the maintaining voltage Vs is set to the highest value thereof (step S7). Then, while current detection is successively performed by the current detection circuit 3 (step S8), the maintaining voltage Vs is gradually lowered (step S9) to detect the maintaining voltage Vs immediately before the discharge current begins to decrease. Then, the detected voltage value M2 is stored into the memory of the microcomputer 1 (step S10).

Then, an optimum voltage value of the maintaining voltage Vs is calculated from the two voltage values M1 and M2 stored in the memory of the microcomputer 1 (step S11). Finally, the input signal to the signal processing circuit 10 is switched back to the normal signal from the normal signal inputting section 6.

Since setting of the maintaining voltage Vs or control of the maintaining voltage Vs, reading of the maintaining voltage Vs and calculation of the optimum maintaining voltage Vs are all performed automatically in this manner, such a phenomenon that, although wall charge is not formed in a cell, discharge occurs in the cell when only the discharge maintaining voltage Vs is applied to the cell, or although wall charge is present and light must be emitted, discharge and emission of light does not occur is eliminated, and equation of the adjustment operation and reduction of the adjustment time can be achieved. Besides, reduction of the number of steps of adjustment upon manufacture of a product and keeping of the display quality when a secular change occurs with the product can be performed efficiently.

Figure 4:
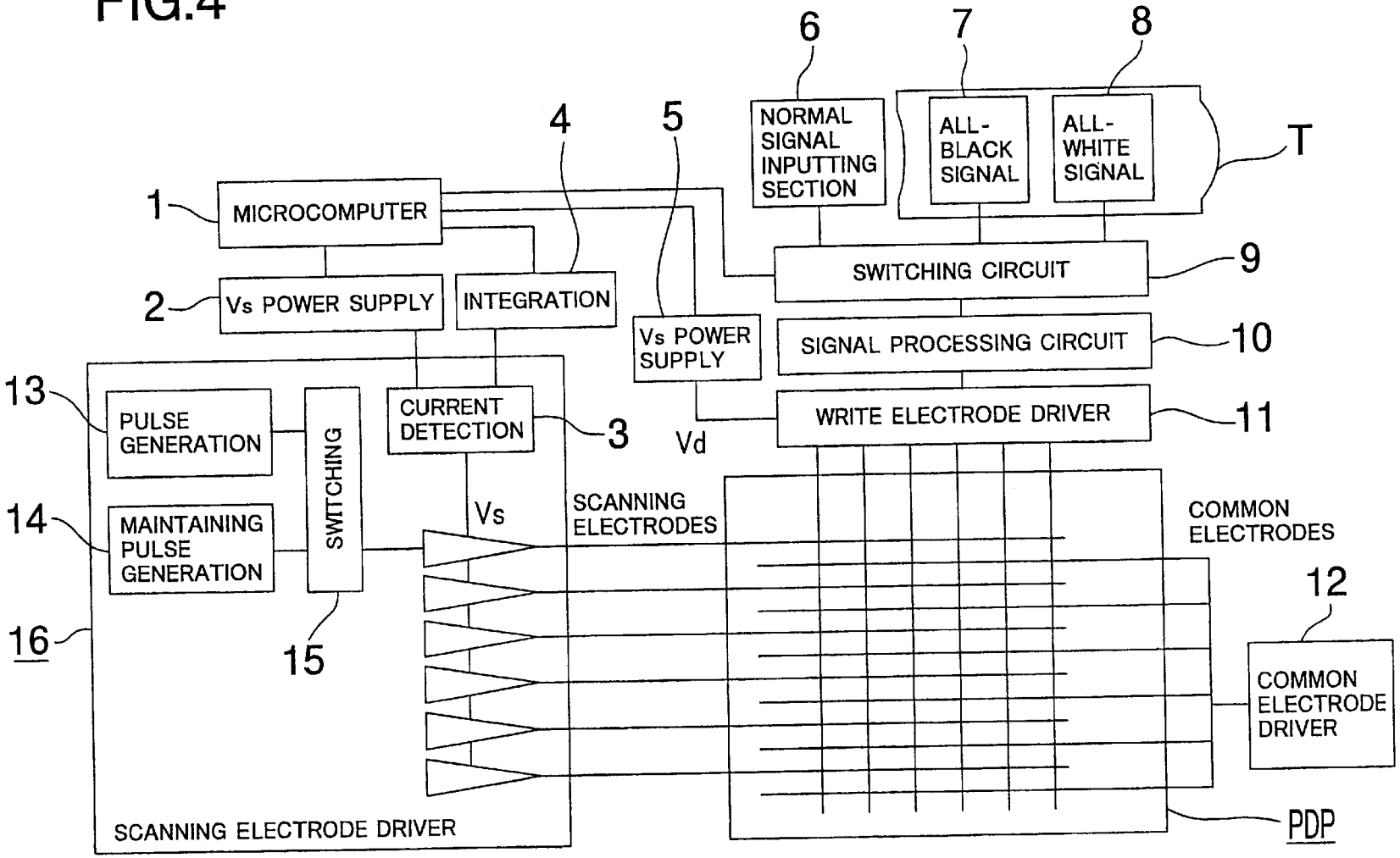
FIG. 4 is a block diagram of a modification to the driving apparatus for a plasma display panel of FIG. 2.

FIG. 4 shows a modification to the driving apparatus for a plasma display panel described hereinabove with reference to FIG. 2. Referring to FIG. 4, in the modified driving apparatus shown, the write discharge maintaining voltage Vd for vertical lines by the discharging voltage (Vd) power supply 5 is varied under the control of the microcomputer 1 to detect a light emitting discharging situation. Then, the optimum write discharge voltage Vd necessary for driving is calculated and variable control of the write voltage Vd is performed in response to a result of the calculation. Also in this instance, similar effects to those described above can be obtained.

While a preferred embodiment of the present invention has been described using specific terms, such description is for illustrative purposes only, and it is to be understood that changes and variations may be made without departing from the spirit or scope of the following claims.

What is claimed is:

1. A driving apparatus for a plasma display panel wherein a discharging gas is filled and enclosed between two glass plates and a plurality of scanning electrodes are provided in a horizontal direction while a plurality of write electrodes are provided in a vertical direction on inner faces of said glass plates and wherein a voltage is selectively applied between said electrodes to cause cells defined by said scanning electrodes and said write electrodes to discharge and emit light, comprising:

a discharging situation detection means for detecting a variation of a state of each of said cells which has an influence on a display quality; and a control means for calculating an optimum driving voltage for the scanning electrode or the write electrode of the cell in response to the discharging situation of the cell detected by said charging situation detection means and causing the optimum driving voltage to be applied to the scanning electrode or the write electrode of the cell to cause the cell to discharge, wherein said discharging situation detection means varies a discharge voltage for the write electrode to detect the light emitting discharging situation, and said control means calculates an optimum voltage necessary to drive the write electrode and applies the optimum voltage to the write electrode, and wherein said discharging situation discharging situation detection means includes a current detection circuit for detecting current to flow to the scanning electrode and an integration circuit for integrating the detection current of said current detection circuit, and said control means includes a signal switching circuit for first inputting an all-black signal and then inputting an all-white signal as a testing signal for detection of the discharging situation to a driver for the write electrode, and a microcomputer for calculating an optimum voltage necessary to drive the write electrode from an output of said integration circuit when the all-black signal in inputted and an output of said integration circuit when the all-white signal is inputted and controlling a voltage of a power supply for the write electrode to the optimum voltage.

* * * * *